US009403206B2

(12) United States Patent
Callesen

(10) Patent No.: US 9,403,206 B2
(45) Date of Patent: Aug. 2, 2016

(54) SPLINE ROLLING RACK AND METHOD

(75) Inventor: Michael David Callesen, Columbia Station, OH (US)

(73) Assignee: U.S. Gear Tools, Inc., Detroit, MI (US)

( * ) Notice: Subject to any disclaimer, the term of this patent is extended or adjusted under 35 U.S.C. 154(b) by 836 days.

(21) Appl. No.: 13/478,663

(22) Filed: May 23, 2012

(65) Prior Publication Data

US 2013/0312475 A1 Nov. 28, 2013

(51) Int. Cl.
*B21H 5/02* (2006.01)
*B21H 3/06* (2006.01)

(52) U.S. Cl.
CPC . *B21H 5/027* (2013.01); *B21H 3/06* (2013.01)

(58) Field of Classification Search
CPC ..... B25B 5/00; B25B 5/08; B21H 5/027; B21H 3/06; B21H 3/02; B21H 7/14; B21H 7/18
USPC ..... 72/482.1, 482.2, 482.92, 446, 448, 449, 72/88, 90, 104, 108; 470/58, 66, 185
See application file for complete search history.

(56) References Cited

U.S. PATENT DOCUMENTS 1,475,618 A * 11/1923 Anderson ..... B25B 1/08 269/208
3,602,026 A * 8/1971 De Caro ..... B21H 3/025 72/469
4,028,921 A * 6/1977 Blue ..... B21H 5/027 29/402.01
4,665,733 A * 5/1987 Wallis ..... B25B 5/064 269/135
4,729,232 A * 3/1988 Hillier ..... B21H 5/027 72/481.4
4,852,375 A 8/1989 Killop et al.
4,882,926 A 11/1989 Anderson
4,993,255 A * 2/1991 Treillet ..... B21D 5/0236 269/229
5,507,169 A 4/1996 Cullen
5,967,221 A * 10/1999 Persson ..... B22C 11/02 164/159
6,301,945 B1 * 10/2001 Roseliep ..... B21H 5/027 72/88
2004/0007034 A1 1/2004 Kreissig
2004/0062597 A1 * 4/2004 Gilliland et al. ..... 403/374.1

OTHER PUBLICATIONS

Internet printout by JEM Industrias Metalúrgicas entitled "Technological Innovation" (Copyright 2008, 2 pages), originally printed Jan. 25, 2012.
Extended European Search Report ("EESR") dated Feb. 11, 2016 in correspondence European Patent Application No. 13793260.4.

* cited by examiner

*Primary Examiner* — Jimmy Nguyen
*Assistant Examiner* — Peter Iannuzzi
(74) *Attorney, Agent, or Firm* — Harness, Dickey & Pierce, P.L.C.

(57) ABSTRACT

A spline rolling rack assembly for cold-forming external surface configurations upon a metal workpiece is provided, having a durable carriage of the type secured upon a reciprocating slide assembly, a perishable rack insert that is removably secured upon the carriage, a locating key disposed between the rack insert and the carriage for properly aligning the rack insert upon the carriage, a locating assembly disposed upon the carriage and engageable with the rack insert for assisting in properly aligning the rack insert and the carriage between load and work positions, and multiple clamping assemblies disposed within said carriage for releasably securing the rack insert upon the carriage. The perishable rack insert is designed for quick and convenient replacement, reducing maintenance cost and idle time for these devices. The single-use insert relieves inventory burden and ensures that replacement tools are ordered in a timely manner.

23 Claims, 5 Drawing Sheets

SECTION A–A
RACK UNCLAMP
POSITION
FASTENING
OPTION 1

SECTION A–A
RACK WORK
POSITION
FASTENING
OPTION 1

SECTION B–B

5' IN RACK INSERT
30
32"
32
32'
34
40
38
39
42
31
FIGURE 9A SECTION E–E 2X SCALE
FIGURE 9B SECTION E–E 2X SCALE WORK POSITION CLAMPED
FIGURE 9C SECTION E–E 2X SCALE LOAD POSITION
FIGURE 9D SECTION E–E 2X SCALE WORK POSITION UNCLAMPED

48'
56
60
16
70
42
63
12
58
61
66
67
68
40
SECTION A–A RACK WORK POSITION ALTERNATE KEYHOLE CONSTRUCTION
FASTENING OPTION 2

48'
56
60
63
F
VIEW D ALTERNATE KEYHOLE CONSTRUCTION 56
57
59
60
SECTION F–F

VIEW 'G'

CARRIAGE KEY
LOADING POSITION

CARRIAGE KEY
WORK POSITION

SPLINE ROLLING RACK AND METHOD

FIELD

The present disclosure relates generally to machines for forming external surface configurations upon metal workpieces by pressure-applied material displacement, and is more specifically directed to spline rolling rack assemblies, components, tooling and devices for securing and manipulating such tooling. The present disclosure also relates to methods for roll-forming splines on the external surfaces of axle, shaft and other power/torque transmission components of the type used in vehicles, machines, commercial and industrial equipment and other devices.

BACKGROUND

This section provides background information related to the present disclosure which is not necessarily prior art.

The manufacture of axle, shaft and other power/torque transmission components of the type used in vehicles, machines, commercial and industrial equipment and other devices often requires the formation of power/torque transmission features upon the external surfaces of round metal workpieces, in the form of rods, tubes, cylinders and other shapes. One exemplary manufacturing method involves spline rolling, which typically utilizes a pair of opposed, elongated, substantially parallel, reciprocating dies, tools or tool members (called "racks") having a series of feature-forming surfaces, such as teeth, disposed in precision arrangements on facing surfaces thereof corresponding to, but not necessarily matching, the desired final surface features of the workpiece to be prepared. Accordingly, spline rolling typically involves reciprocating movement of the opposed dies, tools or tool members (called "racks") over the length of a rotating workpiece, in opposite directions and in overlapping relationship, causing the feature-forming surfaces to displace material upon the surface of the rotating workpiece by applied pressure, in a cold-forming technique. The spline rolling operation thus forms the desired finished external surface features in the workpiece, typically helical or spur ridges, teeth or grooves (or "splines"), through the combination of the rotation of the workpiece with the linear reciprocating movement of the racks. Spline rolling racks are typically constructed in single or double-piece form, with either the single piece or both pieces of a double-piece rack being perishable. They are typically fastened upon suitable opposed, elongated, substantially parallel, reciprocating slide assemblies located within dedicated spline rolling machines of industrial grade.

The nature of forming the desired power/torque transmission features, such as splines, requires critical tolerances in the size and configuration of the feature-forming surfaces, and well as in the spacing, configuration and movement of the racks so that the desired surface features are accurately formed in the workpiece. Thus, these tooling components require precision-crafted feature-forming surfaces and precision mounting apparatus, supports and fasteners within the larger machines in which they are typically contained. However, these tooling components have a limited lifespan, with their feature-forming surfaces typically becoming worn or no longer within required tolerances after some period of their use.

Accordingly, at periodic intervals it is typically necessary to remove the surface-forming tooling components for replacement or resurfacing. Such components can typically be resurfaced a number of times before they can no longer be resurfaced, and as such, must then be replaced. Oftentimes, the manufacture and resurfacing of such tooling components is inefficient due to the time required to ship the components back to the manufacturer for resurfacing and back again to the user. Also, oftentimes, removal and replacement of such tooling components is time-consuming, burdensome and otherwise inefficient, due to the configuration and large size of the components, the current way in which the tooling components are secured in a work position, and the positioning and aligning activities that must typically take place for securing the components in a work position. Having such a machine in an idle state during required maintenance activities slows down overall production rates for any such affected facility, so it is advantageous for such maintenance to be made convenient, efficient and quick.

As examples, the tooling components requiring repair or replacement may be secured within the interior of a larger machine in a way that is inconvenient to manage, such as being secured with fasteners, such as bolts and set screws, that are difficult to reach and manipulate. In addition, the end of a spline rolling rack is typically the primary locating surface for gauging the proper mounting location of the rack within the machine, which can be inconvenient to measure or check for proper alignment. Also, the tooling components may not themselves be manufactured in sufficient tolerances for precision work, or the devices or features provided for facilitating proper positioning may not be sufficient or efficient to use. Proper alignment of the tooling components relative to each other must typically be ensured, which may only be provided in limited scope by relative adjustment of certain surfaces on the machine components when located within the machine that can be difficult to reach and/or examine. The final tolerances required in the feature-forming surfaces may also not be sufficient, or may be manufactured inefficiently, such as by preparing the feature-forming surfaces to required precision tolerances as the final step of the manufacturing process.

In addition, there is typically a substantial cost associated with the replacement or repair of the tooling components involved in such surface forming operations. The sizes of the components can be substantial, depending upon the sizes of the power/torque transmission components being manufactured, perhaps requiring substantial powered lifting equipment for assisting in this activity. The repair or replacement of the tooling components may require shipment and/or courier delivery of substantially-sized and weighted components, at considerable expense. Users of such tooling components must also manage a float of such tools at various levels of life and, due to the lead time required to manufacture new racks, must anticipate tools ending their life span and order new tools to arrive in conjunction with the retirement of existing tools.

In consideration of the above, the adoption of an improved configuration of such surface-forming tooling components along with an improved configuration of the associated devices used for retaining such components in required locations while maintaining the required tolerances for same, would provide significant maintenance efficiencies and cost benefits.

SUMMARY

This section provides a general summary of the disclosure, and is not a comprehensive disclosure of its full scope or all of its features.

The present disclosure provides a spline rolling rack assembly for cold-forming external surface configurations upon a metal workpiece, comprising a durable carriage operable for being fixedly secured upon a reciprocating slide assembly within a machine for forming external surface configurations upon said metal workpiece. The carriage includes a mounting surface and is operable for sliding in reciprocating relation together with rotation of the workpiece. The spline rolling rack assembly further comprises a perishable rack insert that is operable for being removably secured upon said mounting surface of said carriage, the rack insert having a working surface with a series of feature-forming surfaces formed thereupon for cold-forming external surface configurations upon a metal workpiece. The rack insert is operable for being removed from, and secured upon, the carriage within the machine without removing the carriage from within the machine.

The spline rolling rack assembly further comprises a locating key operable for being disposed between a first locating key recess formed within the rack insert and a second locating key recess formed within the carriage for properly aligning the rack insert upon the carriage in at least one of a load position and a work position. Manufactured configurations of the locating key and the first and second locating key recesses together comprise the primary engaging components and surfaces for properly aligning said rack insert upon said carriage in at least one of a load position and a work position. Also, the locating key may preferably be secured to said carriage by a locating bolt.

The spline rolling rack assembly further comprises a locating assembly operable for being disposed upon the carriage in movable relation between a first position corresponding to a loading position of the rack insert upon the carriage and a second position corresponding to a work position of the rack insert upon said carriage. The locating assembly is also operable for engaging a recess within the rack insert, wherein movement of the locating assembly from the first position to the second position engages the locating assembly with the recess within the rack insert to assist in properly aligning the rack insert upon the carriage in at least one of a load position and a work position.

The spline rolling rack assembly further comprises a plurality of clamping assemblies disposed at spaced apart locations longitudinally within the carriage, each clamping assembly operable for releasably contacting the rack insert in a pressurized manner for securing the rack insert in a fixed work position upon the carriage, wherein each clamping assembly is operable for being adjusted between a released unclamped condition and an engaged clamped condition.

Further areas of applicability will become apparent from the description provided herein. The description and specific examples in this summary are intended for purposes of illustration only and are not intended to limit the scope of the present disclosure. It will be appreciated that the above principles may be applied to devices for forming other types of external surface configurations upon other workpieces as well.

DRAWINGS

The drawings described herein are for illustrative purposes only of selected embodiments and not all possible implementations, and are not intended to limit the scope of the present disclosure.

FIG. 9A is an enlarged composite view of the associated locating assembly for the spline rolling carriage and rack insert illustrating its function among multiple positions, according to the present disclosure.

FIG. 9B is an enlarged view of the associated locating assembly for the spline rolling carriage and rack insert in a clamped working position, according to the present disclosure.

FIG. 9C is an enlarged view of the associated locating assembly for the spline rolling carriage and rack insert in a loading position, according to the present disclosure.

FIG. 9D is an enlarged view of the associated locating assembly for the spline rolling carriage and rack insert in an unclamped working position, according to the present disclosure.

Corresponding reference numerals indicate corresponding parts throughout the several views of the drawings.

DETAILED DESCRIPTION

Example embodiments will now be described more fully with reference to the accompanying drawings.

Figure 1:
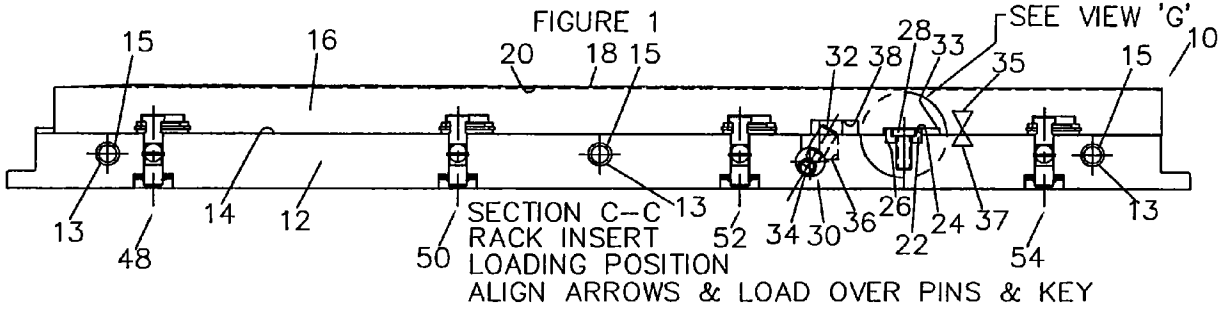
FIG. 1 is a front cross-sectional view of the spline rolling carriage and rack insert in an unsecured loading position, according to the present disclosure.
Figure 2:
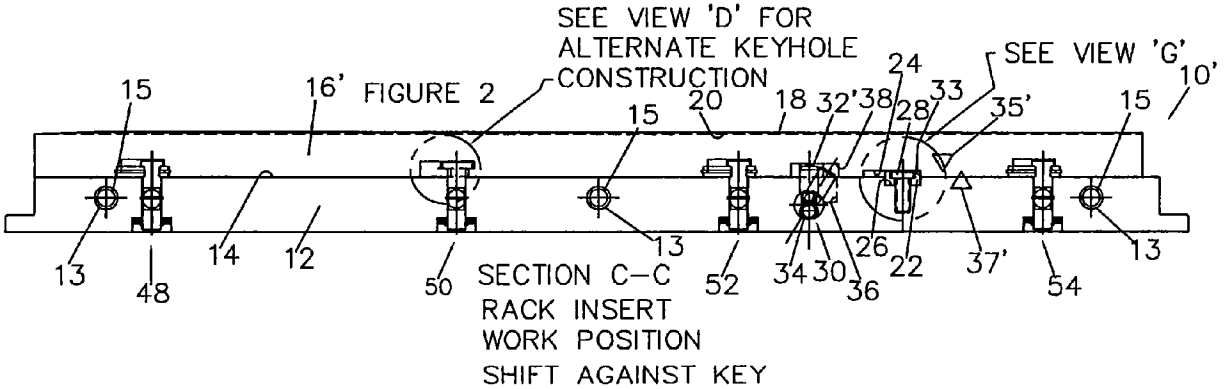
FIG. 2 is a front cross-sectional view of the spline rolling carriage and rack insert in a secured working position, according to the present disclosure.

FIG. 1 illustrates a spline rolling rack assembly, generally at 10, in a loading position, prior to being shifted to the working position illustrated in FIG. 2. The spline rolling rack assembly 10 is a component of a larger, dedicated, machine of industrial grade (not shown) for forming external surface configurations, such as helical or spur ridges, teeth or grooves (or "splines") upon round metal workpieces in the form of rods, tubes, cylinders and other shapes. The spline rolling rack assembly 10 includes a carriage 12 of the type capable of being fixedly secured upon a reciprocating slide assembly (also not shown) within the machine, for sliding in reciprocating relation together with rotation of a workpiece. The carriage 12 is shown to include a carriage mounting surface 14, as well as a plurality of carriage retention apertures 13, through which the carriage 12 is secured to the reciprocating slide assembly by a plurality of carriage retention bolts 15.

The spline rolling rack assembly 10 also includes a rack insert 16 having a working surface 18 that includes a plurality of feature-forming surfaces, shown in the form of teeth 20, formed upon the working surface 18. It will be appreciated that any other suitable feature-forming surfaces may also be formed upon the working surface 18, depending on the surface configurations desired upon the workpiece. The rack insert 16 is designed to be removably secured upon the carriage mounting surface 14 in a quick and convenient way, without requiring the use of extensive bolts or other individual fasteners. Accordingly, the rack insert 16 is intended to be quickly and conveniently removed from its position upon the carriage 12, and replaced into its position and secured upon the carriage 12, whenever repair or replacement of the rack insert 16 is required. The present invention thus provides a dual-component assembly wherein the carriage 12 remains within the larger machine, while only the rack insert 16 is removed and replaced. The configurations and dimensions of the feature-forming surfaces, the carriage 12 and the remainder of the rack insert 16 are manufactured to precision tolerances in configurations and dimensions as may be necessary for creating the required tolerances of configurations and dimensions in the surface configurations being formed upon the workpiece.

The present arrangement therefore contemplates eliminating use of prior perishable single-piece racks or a double-piece racks wherein both pieces are perishable in favor of a two-piece tooling assembly having a durable carriage supporting a perishable rack insert. Such an arrangement is believed to greatly enhance the convenience and speed for removing and replacing the rack inserts 16, which in turn will reduce the time that the spline rolling machine is idle for maintenance. In addition, the rack inserts 16 are preferably designed for a single use, although they may also be refinished and reused as many times as permitted by the required specifications and tolerances of the tooling equipment being used and the workpieces being treated. Because the rack inserts 16 can be of significantly smaller dimensions than a single-piece rack of the type common in previous devices, the new rack inserts 16 of the present invention can be handled and shipped much more quickly, more conveniently and at lower cost.

Figure 13:
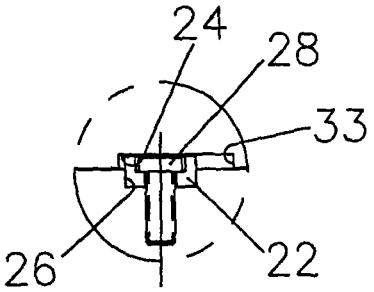
FIG. 13 is an enlarged view of a locating key for the spline rolling carriage and rack insert in a loading position, as shown in FIG. 1, according to the present disclosure.
Figure 14:
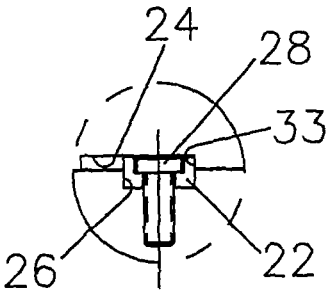
FIG. 14 is an enlarged view of a locating key for the spline rolling carriage and rack insert in a secured working position, as shown in FIG. 2, according to the present disclosure.

As shown in FIGS. 1, 2, 13 and 14, the spline rolling rack assembly 10 further includes a locating key 22 that is disposed between a first locating key recess 24 formed within the rack insert 16 and a second locating key recess 26 formed within the carriage 12. The locating key 22 is secured to the carriage 12 by a locating bolt 28. The locating key recess 24 also includes a primary stop surface 33, which represents the primary location on the rack insert 16 that bears against the locating key 22. In the manufacture of a cooperating pair of rack inserts 16, the working surface 18 of each rack insert 16 is ground to specified tolerances while utilizing each primary stop surface 33 as the primary locating datum for each rack insert 16, thus ensuring that the rack inserts 16 are synchronized. The locating key 22, in connection with the first locating key recess 24 and the second locating key recess 26, together comprise the primary engaging components and surfaces for properly aligning the rack insert 16 upon the carriage mounting surface 14 of the carriage 12 in a load position, as illustrated in FIGS. 1 and 13, as well as in a work position, as set forth below in connection with FIGS. 2 and 14 (wherein the spline rolling rack assembly is referenced at 10 and the rack insert is designated at 16'). Accordingly, the manufactured configurations and dimensions of the locating key 22, the first locating key recess 24 and the second locating key recess 26 are prepared to sufficiently precise tolerances for providing sufficiently precise tolerances in the position of the feature-forming surfaces of the working surface 18 of the rack insert 16. Use of the locating key 22 is believed to provide a quicker and more easily accessed method for aligning the rack insert 16 upon the carriage 12 than would be possible through other, manual, alignment methods that might rely on visual or tactile inspection of the various component surfaces.

The spline rolling rack assembly 10 further includes a locating assembly, generally at 30. The locating assembly 30 includes a lock pin 32 attached to a lock shaft 34 that is rotatably disposed within a first locating assembly recess 36 of the carriage 12. It will be appreciated that multiple lock pins 32 may be employed, depending on the application. The lock pin 32 extends from the lock shaft 34 outwardly from within the first locating assembly recess 36 of the carriage 12 to within a second locating assembly recess 38 of the rack insert 16, which forms a stop for movement of the rack insert 16 once it reaches a work position. The lock pin 32 and lock shaft 34 are together capable of being rotated between a first position corresponding to a load position of the rack insert 16 upon the carriage 12 (represented by the position of the lock pin 32 in FIG. 1) and a second position corresponding to a work position of the rack insert 16 upon the carriage (represented by the position of the lock pin 32' in FIG. 2). The counter-clockwise rotation of the lock pin 32 and lock shaft 34 together is accompanied by a longitudinal sliding movement of the rack insert 16 upon the mounting surface 14 of the carriage 12 between a load position for the assembly (represented by the designation 10 in FIG. 1) to a work position for the assembly (represented by the designation 10' in FIG. 2). In similar fashion, the load position and work position for the rack insert are designated as 16 and 16', respectively, in FIGS. 1 and 2. Rotation of the lock pin 32 and lock shaft 34 in a clockwise direction (from 32' in FIG. 2 to 32 in FIG. 1) returns the assembly from a work position (10' in FIG. 2) to a load position (10 in FIG. 1) for removal and replacement of the rack insert 16. Accordingly, the movement of the locating assembly 30 in this manner assists in properly aligning the rack insert 16 upon the carriage 12 between a load position and a work position. Load arrows 35 and 37 are provided in the form of indicia disposed upon, or alternately imprinted into, the external side surfaces of the rack insert 16 and carriage 12, respectively, for assisting in the alignment of the rack insert 16 upon the carriage 12 in a load position. As shown in FIG. 2, movement of the rack insert 16 longitudinally upon the carriage 12 from a load position to a work position displaces the load arrow 35 to the location referenced at 35'. Movement of the rack insert 16 from the work position back to the load position realigns the load arrows to ensure that the rack insert 16 is in the proper position for removal from upon the carriage 12.

Figure 3:
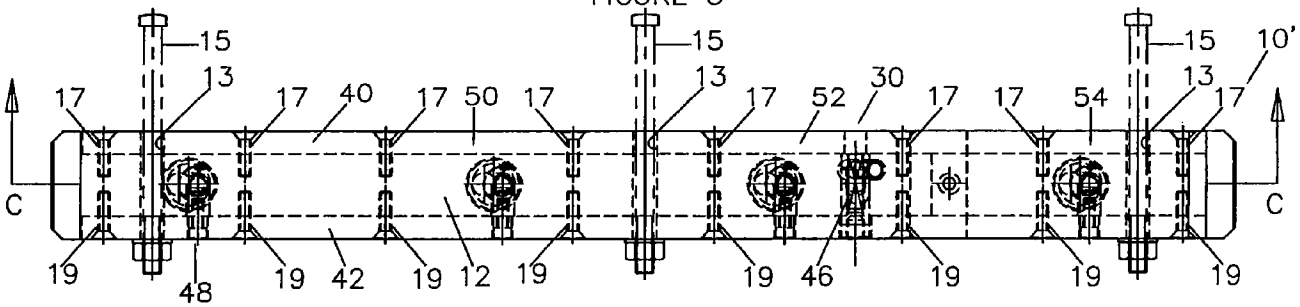
FIG. 3 is a cross-sectional plan view of the spline rolling carriage and rack insert in a secured working position, according to the present disclosure.
Figure 4:
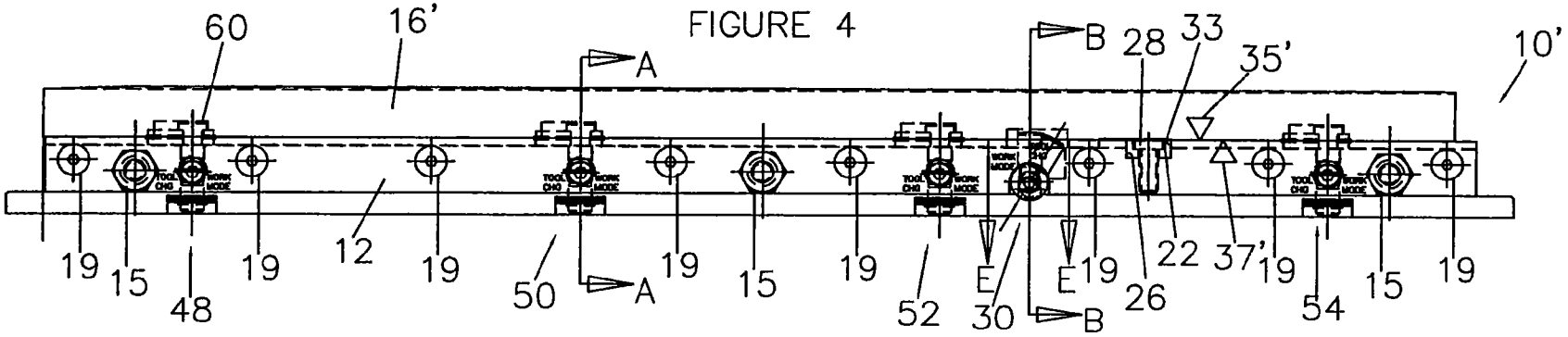
FIG. 4 is a front cross-sectional view of the spline rolling carriage and rack insert in a secured working position, also showing the clamp pins in the secured working position as well as the actuator used to manipulate the insert between the unsecured loading position and secured working position of the associated locating assembly, according to the present disclosure.

FIGS. 3 and 4 show a cross-sectional plan view and a front cross-sectional view, respectively, of the spline rolling carriage and rack insert of the spline rolling carriage and rack insert in a secured working position. From this view, the carriage retention bolts 15 are shown as being disposed within carriage retention apertures 13. The carriage retention bolts 15 are operable for securing the carriage 12 to the reciprocating slide assembly (not shown). In addition, there are shown a plurality of inner and outer datum rail fasteners 17 and 19, which secure the inner and outer datum rails 40 and 42, respectively, to the carriage 12.

Figure 8:
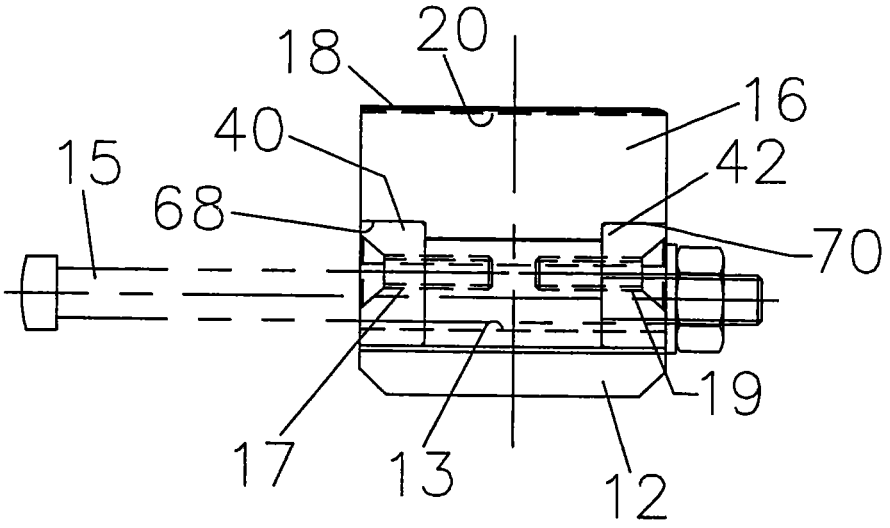
FIG. 8 is an end cross-sectional view showing a carriage retention bolt and inner and outer datum rail fasteners for the spline rolling carriage and rack insert, according to the present disclosure.

FIG. 8 shows in greater detail an end cross-sectional view of a carriage retention bolt 15 disposed through a carriage retention aperture 13 for securing the carriage 12 to a reciprocating slide assembly. Inner and outer datum rail fasteners 17 and 19 (also shown in FIG. 3) are shown to secure the inner datum rail 40 and the outer datum rail 42, respectively, in place upon the carriage 12.

Figure 7:
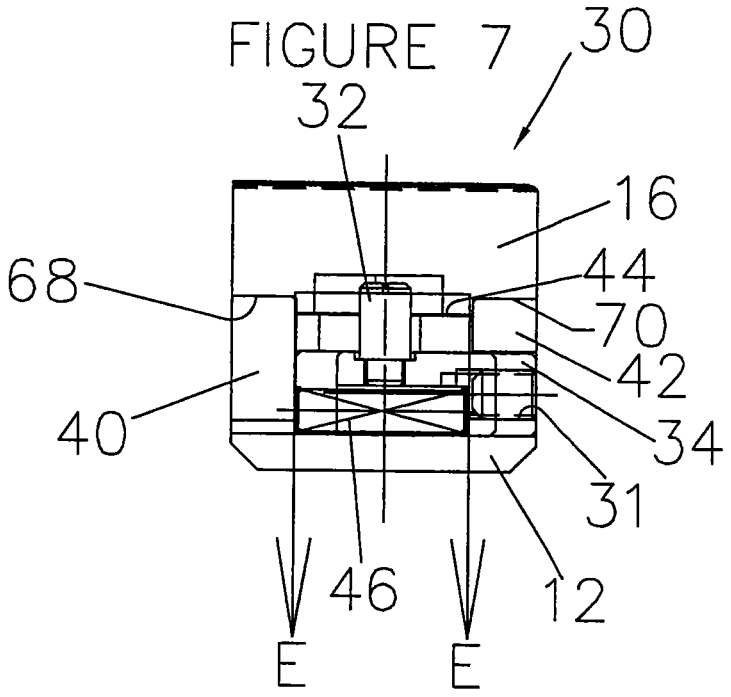
FIG. 7 is an end cross-sectional view showing the associated locating assembly for the spline rolling carriage and rack insert, according to the present disclosure.

The components of the locating assembly 30 are shown in greater detail with reference to FIG. 7, viewed in a longitudinal direction. FIG. 7 shows the rack insert 16 disposed upon the carriage 12. However, in this view, it can be seen that the carriage 12 includes inner datum rail 40 and outer datum rail 42 upon which the rack insert 16 is positioned, which serve as locating and/or alignment rails in both load and work positions of the assembly 10. The rack insert 16 includes a male rack alignment protrusion 44 that fits between the inner and outer datum rails 40 and 42, such that the longitudinal orientation of the rack insert 16 is determined by a close fit between the rack alignment protrusion 44 and the interior surfaces of the inner and outer datum rails 40 and 42. The lock pin 32 and lock shaft 34 are shown to engage a compression spring 46 which forces the lock pin 32 and lock shaft 34 among two counter-clockwise positions between an unclamped, but compressed, condition, and a clamped, partially-relaxed but engaged condition, which in turn correspond to the load position, work position (unclamped) and work position (clamped) of the assembly 10 respectively, as previously described.

The various operating positions of the locating assembly 30 are shown in greater detail with reference to FIGS. 9A-9D, viewed in an enlarged upper cross-sectional view. FIG. 9A is a composite view of the locating assembly illustrating its function among the multiple positions of the lock pin 32 during operation of this assembly. Operation of the locating assembly 30 is accomplished through the insertion of an Allen wrench (not shown) into the Allen wrench recess 31 of the lock shaft 34, and subsequent rotation of the lock shaft 34. FIG. 9C shows the locating assembly 30 in a loading position, with the lock pin 32 in a first position corresponding to that condition. FIG. 9D shows the locating assembly in an unclamped working position, resulting from rotation of the lock shaft 34 in a counter-clockwise manner, which moves the lock pin to the position designated as 32". Release of the lock shaft 34 from the position shown in FIG. 9D then allows the lock pin to move to the position designated at 32' in FIG. 9B, which shows the locating assembly 30 in a clamped working position. The locating assembly 30 is also shown to have a taper of five degrees formed as a tapered recess side 39 of the second locating assembly recess 38 in the rack insert 16 through which the lock pin 32 is disposed. In the operation of the locating assembly 30, the lock pin 32 is forced against this taper in the clamped working position and maintains bearing of the locating key 22 against the primary stop surface 33, which helps to retain the lock pin 32 in the desired positions. Alternatively, it will be appreciated that other suitable tapers besides five degrees could also be used.

Referring again to FIGS. 1-4, the spline rolling rack assembly 10 further includes a plurality of clamping assemblies, generally shown at 48, 50, 52 and 54. Four clamping assemblies are shown in this example, although it will be appreciated that any suitable number of such clamping assemblies may be used depending on the configuration, dimensions and load requirements of the assembly 10. The clamping assemblies 48, 50, 52 and 54 are disposed at spaced apart locations longitudinally within the carriage 12, and operate to releasably secure the rack insert 16 in a pressurized manner in a fixed work position upon the carriage 12, once the rack insert 16 has been moved from the load position to the work position. Each clamping assembly is operable for being adjusted between a released unclamped condition and an engaged clamped condition. The clamping assemblies operate by cam mechanisms which secure the rack insert 16 relative to the carriage 12 by a pressure action, which is believed to be more quickly and conveniently operated than the use of numerous individual bolts for securing these components together.

Figure 5:
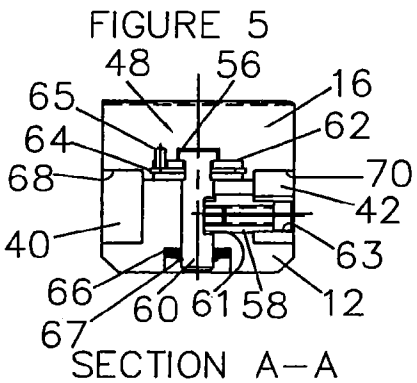
FIG. 5 is an end cross-sectional view of the associated clamping assembly for the spline rolling carriage and rack insert in a secured working position, according to the present disclosure.

The components and functions of the clamping assemblies will be discussed in greater detail with reference to FIGS. 5, 6 and 10, which show alternate embodiments of clamping assembly configurations, generally referenced with the numerals 48 and 48'. As with the locating assembly 30, the clamping assemblies 48 and 48' are each constructed as part of the carriage 12, but also each engage a clamping assembly recess 56 within the rack insert 16. As shown in FIG. 5, the clamping assembly 48 includes a cam 58 disposed within the carriage 12 that is accessible from the exterior of the carriage 12 through Allen wrench recess 63, and engages a clamp pin 60. The clamping assembly 48 also includes a keyhole insert 62 disposed against the rack insert 16 defining a passage for the clamp pin 60 to travel through for engaging the clamping assembly recess 56, as well as a stop for release of the clamp pin 60. Accordingly, the lock pin 60 is held in the assembly by virtue of its interface with the cam 58. The clamping assembly recess 56 also includes a snap ring 64 for retaining the keyhole insert 62 in place and an anti-rotation pin 65 for providing proper orientation for the keyhole insert 62. Disc springs 66 are also provided at an end portion of the clamp pin 60 for providing a suitable clamping force when the cam 58 is released, which are retained upon the clamp pin 60 by a snap ring 67.

Figure 6:
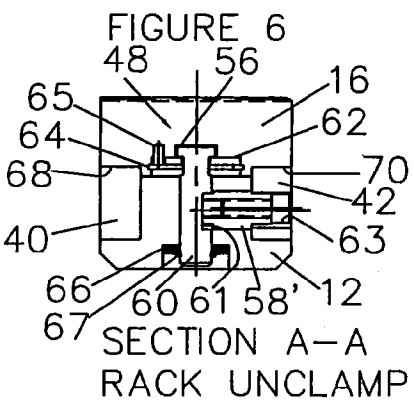
FIG. 6 is an end cross-sectional view of the associated clamping assembly for the spline rolling carriage and rack insert in an unsecured loading or working position, according to the present disclosure.

The cam 58 and clamp pin 60 are shown in a clamped work condition in FIG. 5, and in an unclamped condition in FIG. 6. In the operation of this portion of the assembly, rotation of the cam from the configuration 58' shown in FIG. 6 into the configuration 58 shown in FIG. 5 forces the clamp pin 60 downwardly toward the clamping assembly recess 56 of the rack insert 16, thus placing the rack insert 16 and the carriage 12 in an engaged clamped condition. Similarly, rotation of the cam from the configuration 58 shown in FIG. 5 into the configuration 58' shown in FIG. 6 forces the clamp pin 60 upwardly away from the clamping assembly recess 56 of the rack insert 16, thus placing the rack insert 16 and the carriage 12 in a released unclamped condition. When this activity is performed for multiple clamping assemblies disposed longitudinally along the assembly 10, the rack insert 16 and the carriage 12 can be clamped in the work position and unclamped, as desired. In each case, the clamping force on the rack insert 16 is spring pressure, as actuating the clamp pin 60 as described above compresses and decompresses the springs in order to unclamp and clamp the rack insert 16, respectively.

Figures 10, 11, 12:
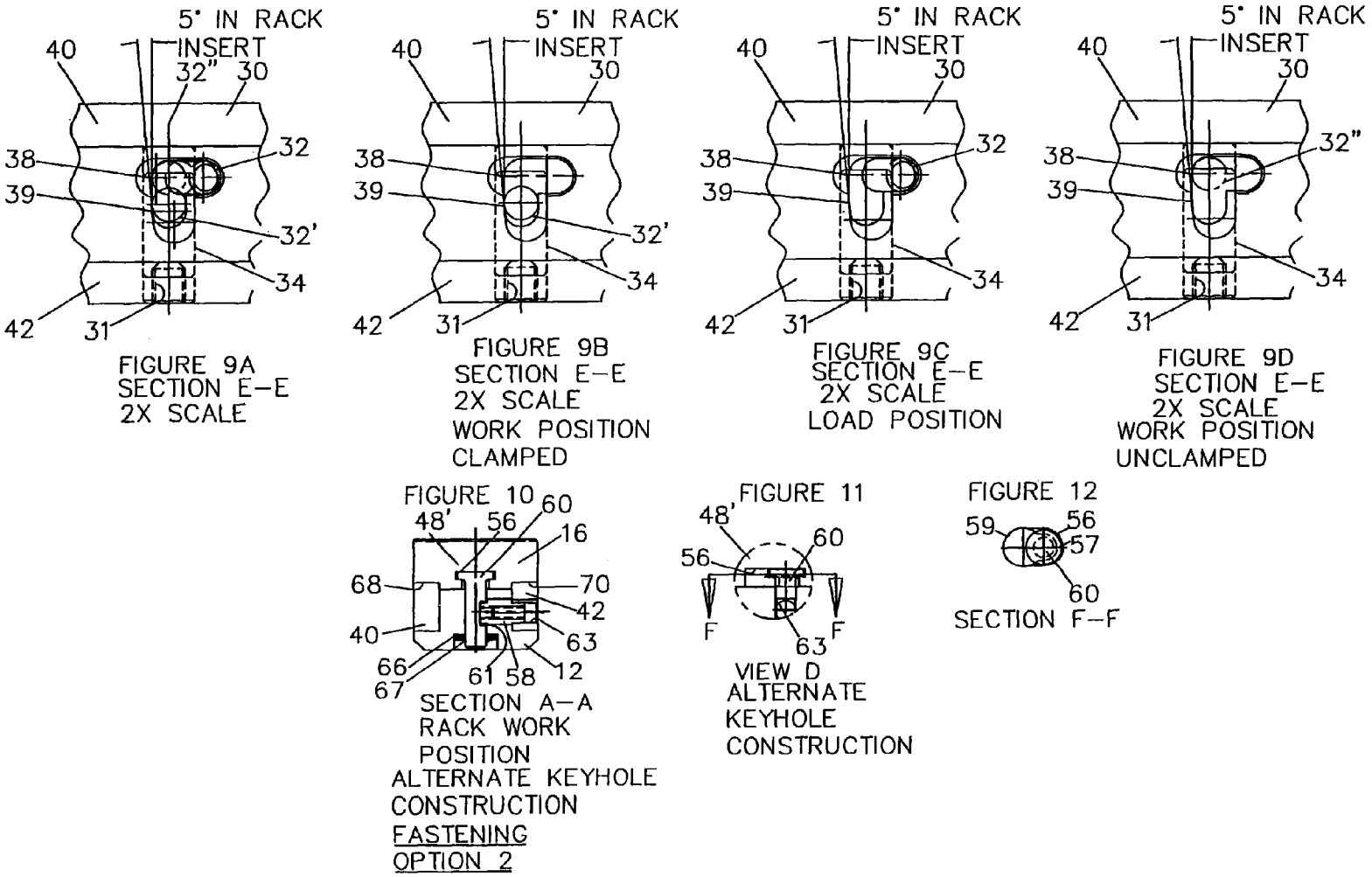
FIG. 10 is an end cross-sectional view of an alternate associated clamping assembly for the spline rolling carriage and rack insert in a secured working position, according to the present disclosure.
FIG. 11 is an enlarged front cross-sectional view of an alternate associated clamping assembly for the spline rolling carriage and rack insert in a secured working position, according to the present disclosure.
FIG. 12 is an enlarged view of an alternate associated clamping assembly recess machined directly into the rack insert, according to the present disclosure.

FIG. 10 shows an alternate construction for the clamping assembly, generally referred to at 48'. Unlike the embodiment shown in FIGS. 5 and 6, this embodiment does not use a keyhole insert 62 or snap ring 64. Instead, in this embodiment, the clamping assembly recess 56 is machined directly into the rack insert 16. In similar manner as for the previous embodiment shown in FIGS. 5 and 6, the clamping assembly 48' also includes a cam 58 disposed within the carriage 12 that is accessible from the exterior of the carriage 12 through Allen wrench recess 63, for engaging a clamp pin 60. In this embodiment, the clamping assembly recess 56 itself defines a passage for the clamp pin 60 to travel, as well as a stop for release of the clamp pin 60. Again, rotation of the cam 58 forces the clamp pin 60 downwardly toward the clamping assembly recess 56 of the rack insert 16, thus placing the rack insert 16 and the carriage 12 in an engaged clamped condition. Similarly, rotation of the cam 58 back to its previous position forces the clamp pin 60 upwardly away from the clamping assembly recess 56 of the rack insert 16, releasing the clamp pin 60 from its pressurized contact with the recess 56 of the rack insert 16 and placing the rack insert 16 and the carriage 12 in a released unclamped condition.

FIG. 11 shows an enlarged front cross-sectional view of the alternate associated clamping assembly in a secured working position. From this view, and in combination with FIG. 12, it can be seen that the clamping assembly recess 56 has a small radius recess 57 and a large radius recess 59, each formed as part of the clamping assembly recess 56. The large radius recess 59 allows the clamp pin 60 to enter the clamping assembly recess 56 and corresponds to the load position. When the rack insert 16 is moved to the work position, the underside of the clamp pin 60 engages the small radius recess 57 by virtue of the applied pressure from disc springs 66 once the cam 58 is released.

As shown in the longitudinal views of FIGS. 5, 6, 7 and 10, the primary contacting surfaces of the rack insert 16 against the inner and outer datum rails 40 and 42 of the carriage 12 are designated as the inner height location datum 68 and outer height location datum 70. The inner height location datum 68 and outer height location datum 70 serve the function of being the surfaces that are manufactured to the closest tolerances (and typically formed last in the manufacturing process of the rack insert 16) so that the feature-forming surfaces (such as teeth 20) of the rack insert 16 can in turn be brought to the closest configuration and dimension tolerances. It is believed that using the inner height location datum 68 and outer height location datum 70 in this way provides improved tolerances in a more efficient manner of manufacturing the rack insert 16, as opposed to the previous method of manufacturing the required tolerances (such as by grinding) into the feature-forming surfaces (such as teeth 20) as the final manufacturing step of the rack insert 16.

In the method of the present disclosure, the rack insert 16 is positioned upon the mounting surface 14 of the carriage 12 in such a manner that the load arrows 35 and 37 are aligned, as shown in FIG. 1. In this condition, the locating key 22 (which is secured upon the carriage 12 by the locating bolt 28) engages the first locating key recess 24 disposed within the rack insert 16. At the same time, the clamp pin 60 engages the large radius recess 59 of the clamping assembly recess 56 in the rack insert 16, as shown in FIG. 12. The locating assembly 30 is then actuated by the engagement of Allen wrench recess 31 with a suitable Allen wrench, so that the lock shaft 34 is rotated counter-clockwise, moving the rack insert 16 longitudinally relative to the carriage 12 into the working position (but unclamped) shown in FIG. 2. In this activity, the load arrows become displaced relative to each other, as shown at reference numerals 35' and 37' in FIG. 2, and the lock pin moves from the loading position shown at numeral 32 in FIG. 9C to the position shown at numeral 32" in FIG. 9D, which represents the unclamped working position of the assembly. Release of the lock shaft 34 then allows it to travel toward the front of the assembly under spring pressure exerted by spring 46, shown in FIGS. 3 and 7, which permits the lock pin to bear against the tapered recess side 39 in the rack insert 16 in the position designated with the numeral 32' in FIG. 9*b*, which represents the clamped working position of the assembly. At the same time, this activity forces the locating key 22 to bear upon the primary stop surface 33, as shown in FIGS. 1, 2, 13 and 14.

Securing the assembly in the clamped working position also requires the release of cam 58 in each clamping assembly 48, 50, 52 and 54 by engaging the Allen wrench recess 63 with a suitable Allen wrench and rotating the cam 58 in either a clockwise or counter-clockwise direction within the lock pin recess 61 such as to the position marked as 58 in the embodiment shown in FIG. 5 (and performed similarly in the embodiment illustrated in FIG. 10). This in turn causes the clamp pin 60 to travel in a manner away from the rack insert 16, which partially relaxes the disc springs 66 and allows the clamp pin 60 to bear on the clamping assembly recess 56.

Removal of the rack insert 16 from upon the carriage 12 involves releasing each clamping assembly 48, 50, 52 and 54 from the clamped to the unclamped condition while the overall assembly is in the working position. To accomplish this (for each clamping assembly), the Allen wrench recess 63 is engaged with a suitable Allen wrench and rotated clockwise or counter-clockwise within the lock pin recess 61, which causes the clamp pin 60 to travel toward the rack insert 16, releasing the clamp pin 60 from bearing upon the clamping assembly recess 56 and unclamping the assembly. The assembly is then moved from the working position to the loading position by actuating the locating assembly 30 by the engagement of Allen wrench recess 31 with a suitable Allen wrench, so that the lock shaft 34 may be depressed and then rotated clockwise, moving the rack insert 16 longitudinally relative to the carriage 12 into the loading position shown in FIG. 1, with the load arrows moving from the unaligned positions shown at 35' and 37' in FIG. 2 to the aligned positions shown at 35 and 37 in FIG. 1. Once in the loading position, the rack insert 16 may be removed from upon the mounting surface 14 of the carriage 12.

Since typical spline rolling racks include upper and lower spline rolling rack assemblies such as the assembly described herein, it will be appreciated that the above description of both apparatus and method typically apply to both an upper and lower assembly, which must both be installed and secured before operation of the overall spline rolling rack machine can begin.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A spline rolling rack assembly for cold-forming external surface configurations upon a metal workpiece, comprising:

a durable carriage operable for being fixedly secured upon a reciprocating slide assembly within a machine for forming external surface configurations upon said metal workpiece, said carriage having a mounting surface, said carriage operable for sliding in reciprocating relation together with rotation of the workpiece;

a perishable rack insert operable for being removably secured upon said mounting surface of said carriage, said rack insert having a working surface with a series of feature-forming surfaces formed thereupon for cold-forming external surface configurations upon a metal workpiece and a locking bearing surface, said rack insert operable for being removed from, and secured upon, said carriage within said machine without removing said carriage from within said machine;

a locating key operable for being disposed between a first locating key recess formed within said rack insert and a second locating key recess formed within said carriage for properly aligning said rack insert upon said carriage in at least one of a load position and a work position, wherein manufactured configurations of said locating key and said first and second locating key recesses together comprise primary engaging components and surfaces for properly aligning said rack insert upon said carriage in at least one of a load position and a work position, and wherein said locating key is secured to said carriage;

a locating assembly operable for being disposed upon said carriage in movable relation between a first position corresponding to a loading position of said rack insert upon said carriage and a second position corresponding to a work position of said rack insert upon said carriage, said locating assembly also operable for engaging a recess within said rack insert, wherein movement of said locating assembly from said first position to said second position engages said locating assembly with said recess within said rack insert to assist in properly aligning said rack insert upon said carriage in at least one of a load position and a work position, wherein said locating assembly comprises a lock pin attached to a lock shaft rotatably disposed within said carriage and capable of being rotated between a first position corresponding to a load position of said rack insert upon said carriage and a second position where the locking shaft engages a tapered surface of the insert corresponding to a work position of said rack insert upon said carriage; and a plurality of clamping assemblies disposed at spaced apart locations longitudinally within said carriage, each clamping assembly having a translatable locking member with an annular engagement surface configured to engage the locking bearing surface of the rack insert, the translatable locking member having a shaft defining a cam following surface, said clamping assemblies each having a rotatable member disposed generally perpendicular to the shaft and having a cam configured to engage the cam following surface upon rotation of the rotatable member in a first direction, the translatable member being operable for releasably contacting said rack insert in a pressurized manner for securing said rack insert in a clamped work position upon said carriage, wherein each clamping assembly is operable for being adjusted between a released unclamped condition and an engaged clamped condition.

2. A spline rolling rack assembly according to claim 1, wherein each clamping assembly comprises a surface disposed within said carriage and operable for engaging a clamp pin forming part of the clamping assembly into an engaged clamped condition against said rack insert.

3. A spline rolling rack assembly according to claim 1, wherein each clamping assembly is operable for engaging a recess within said rack insert, and wherein adjustment of said clamping assembly from a released unclamped condition to an engaged clamped condition operates to engage a clamp pin forming part of the clamping assembly against said recess within said rack insert.

4. A spline rolling rack assembly according to claim 1, wherein said carriage includes longitudinally disposed inner and outer datum rails for engaging a male protrusion upon said rack insert in close fit relation to assist in properly aligning said rack insert upon said carriage in at least one of a load position and a work position.

5. A spline rolling rack assembly according to claim 4, wherein said rack insert further comprises inner and outer datum surfaces whose manufactured configurations are prepared to precision tolerances which in turn operate to enhance precision tolerances in the location of said feature-forming surfaces when said rack insert is in said work position.

6. A spline rolling rack assembly according to claim 1, wherein manufactured configurations of said locating key and said first and second locating key recesses are prepared to precision tolerances which in turn operate to enhance precision tolerances in the location of said feature-forming surfaces when said rack insert is in said work position.

7. A spline rolling rack assembly according to claim 1, wherein said rack insert is designed for a single use and is intended for disposal after said working surface becomes worn.

8. A spline rolling rack assembly according to claim 1, wherein said locating key is secured to said carriage by a locating key bolt.

9. A spline rolling rack assembly according to claim 1, wherein said rack insert and said carriage each include load alignment indicia on corresponding surfaces for indicating when the rack insert and the carriage are aligned in a load position, prior to sliding the rack insert longitudinally upon the carriage into a work position.

10. A spline rolling rack assembly according to claim 1, wherein said rack insert comprises at least one height location datum in contact with the carriage during operation, whose manufactured configuration is each prepared to precision tolerances which in turn operate to enhance precision tolerances in the location of said feature-forming surfaces when said rack insert is in said work position.

11. A spline rolling rack assembly according to claim 10, wherein said rack insert comprises inner and outer height location datums which are mounted upon, and correspond to, inner and outer datum rails formed upon the carriage.

12. A spline rolling rack assembly according to claim 1, wherein said external surface configurations formed upon a metal workpiece are in the form of splines.

13. A spline rolling rack assembly for cold-forming external surface configurations upon a metal workpiece, comprising:

a durable carriage operable for being fixedly secured upon a reciprocating slide assembly within a machine for forming external surface configurations upon said metal workpiece, said carriage having a mounting surface, said carriage operable for sliding in reciprocating relation together with rotation of the workpiece;

a perishable rack insert operable for being removably secured upon said mounting surface of said carriage, said rack insert having a working surface with a series of feature-forming surfaces formed thereupon for cold-forming external surface configurations upon a metal workpiece, said rack insert defining a coupling aperture holding an insert bearing plate defining a bearing surface, said rack insert operable for being removed from, and secured upon, said carriage within said machine without removing said carriage from within said machine;

a locating key operable for being disposed between a first locating key recess formed within said rack insert and a second locating key recess formed within said carriage for properly aligning said rack insert upon said carriage in at least one of a load position and a work position, wherein manufactured configurations of said locating key and said first and second locating key recesses together comprise primary engaging components and surfaces for properly aligning said rack insert upon said carriage in at least one of a load position and a work position; and a plurality of clamping assemblies disposed at spaced apart locations longitudinally within said carriage, each clamping assembly having a translatable locking member with an engagement surface configured to engaged the ramped bearing surface of the rack insert, the translatable locking member having a shaft defining a cam following surface, said clamping assemblies each having a rotatable member disposed generally perpendicular to the shaft and having a cam configured to engage the ramped bearing surface upon rotation of the rotatable member in a first direction, the translatable member being each clamping assembly operable for releasably contacting said rack insert in a pressurized manner for securing said rack insert in a fixed work position upon said carriage, wherein each clamping assembly is operable for being adjusted between a released unclamped condition and an engaged clamped condition.

14. A spline rolling rack assembly for cold-forming external surface configurations upon a metal workpiece, comprising:

a durable carriage operable for being fixedly secured upon a reciprocating slide assembly within a machine for forming external surface configurations upon said metal workpiece, said carriage having a mounting surface, said carriage operable for sliding in reciprocating relation together with rotation of the workpiece;

a perishable rack insert operable for being removably secured upon said mounting surface of said carriage, said rack insert having a working surface with a series of feature-forming surfaces formed thereupon for cold-forming external surface configurations upon a metal workpiece, said rack insert defining a coupling bearing surface, said perishable rack insert being operable for being removed from, and secured upon, said carriage within said machine without removing said carriage from within said machine; and a plurality of clamping assemblies disposed at spaced apart locations longitudinally within said carriage, each clamping assembly having a selectively rotatably translatable member with a ramped annular engagement surface configured to engage the coupling bearing surface of the rack insert, the selectively rotatably translatable member having a shaft defining a cam following surface, said clamping assemblies each having a movable member disposed generally perpendicular to the shaft and having a cam configured to engage the cam following surface upon rotation of the rotatable member in a first direction, the selectively translatable member being operable for releasably contacting said rack insert in a pressurized manner for securing said rack insert in a fixed work position upon said carriage, wherein each clamping assembly is operable for being adjusted between a released unclamped condition and an engaged clamped condition.

15. A method for preparing a spline rolling rack assembly for cold-forming external surface configurations upon a metal workpiece comprising the steps of:

providing a durable carriage fixedly secured upon a reciprocating slide assembly within a machine for forming external surface configurations upon said metal workpiece;

providing a perishable rack insert defining a clamping assembly recess having a selectively engagable bearing surface operable for being removably secured upon a mounting surface of said carriage;

disposing a keyhole insert defining a bearing surface within the clamping assembly recess;

positioning said rack insert upon said mounting surface of said carriage, so as to engage a locating key secured upon said carriage with a locating key recess disposed within said rack insert, to engage a locating assembly disposed upon said carriage with a locating assembly recess disposed within said rack insert, and also to engage at least one clamping assembly disposed upon said carriage with the selectively engagable bearing surface, wherein said locating assembly comprises a lock pin attached to a lock shaft rotatably disposed within said carriage and capable of being rotated between a first position corresponding to a load position of said rack insert upon said carriage and a second position where the locking shaft engages a tapered surface of the insert corresponding to a work position of said rack insert upon said carriage;

actuating said locating assembly to move said rack insert longitudinally relative to said carriage into a working position, to engage said locating key against a primary stop surface forming part of said locating key recess, and also to place said clamping assembly in a configuration to be secured into a clamped condition; and securing said at least one clamping assembly into a clamped condition between said carriage and said rack insert.

16. The method for preparing a spline rolling rack assembly according to claim 15, wherein the step of positioning said rack insert upon said mounting surface of said carriage comprises engaging a plurality of clamping assemblies disposed upon said carriage with a plurality of clamping assembly recesses disposed within said rack insert; and wherein the step of securing said at least one clamping assembly into a locked condition between said carriage and said rack insert comprises rotating a plurality of clamping assemblies into a locked condition between said carriage and said rack insert.

17. The method for preparing a spline rolling rack assembly according to claim 15, wherein the step of positioning said rack insert upon said mounting surface of said carriage causes a clamp pin protruding from said carriage to engage a large radius recess forming part of said clamping assembly recess in said rack insert.

18. The method for preparing a spline rolling rack assembly according to claim 17, wherein the step of actuating said locating assembly causes said clamp pin to switch from engaging said large radius recess to engaging a small radius recess forming part of said clamping assembly recess in said rack insert.

19. The method for preparing a spline rolling rack assembly according to claim 18, wherein the step of securing said at least one clamping assembly into a clamped condition between said carriage and said rack insert comprises securing said clamp pin against said small radius recess.

20. The method for preparing a spline rolling rack assembly according to claim 15, wherein said step of actuating a locating assembly disposed upon said carriage to engage said rack insert comprises causing a lock pin to move from a first load position to a second work-unclamped position and subsequently to a third work-clamped position between said carriage and said rack insert.

21. A spline rolling rack assembly for cold-forming external surface configurations upon a metal workpiece, comprising:

a durable carriage operable for being fixedly secured upon a reciprocating slide assembly within a machine for forming external surface configurations upon said metal workpiece, said carriage having a mounting surface, said carriage operable for sliding in reciprocating relation together with rotation of the workpiece;

a perishable rack insert having a tapered coupling bearing surface, said perishable rack operable for being removably secured upon said mounting surface of said carriage, said rack insert having a working surface with a series of feature-forming surfaces formed thereupon for cold-forming external surface configurations upon a metal workpiece, said rack insert operable for being removed from, and secured upon, said carriage within said machine without removing said carriage from within said machine; and a selectively translatable member coupled to a rotatable shaft and having an engagement surface configured to engage the tapered coupling bearing surface of the rack insert, said selectively translatable member having a movable member disposed generally perpendicular to the shaft and having a cam configured to engage the tapered coupling bearing surface upon rotation of the rotatable member in a first direction, and to disengage the tapered coupling bearing surface upon rotation of the rotatable member in a second direction.

22. A spline rolling rack assembly according to claim 21, wherein said rack insert is designed for a single use and is intended for disposal after said working surface becomes worn.

23. A spline rolling rack assembly for cold-forming external surface configurations upon a metal workpiece, comprising:

a durable carriage operable having a clamping assembly for being fixedly secured upon a reciprocating slide assembly within a machine for forming external surface configurations upon said metal workpiece, said carriage having a mounting surface, said carriage operable for sliding in reciprocating relation together with rotation of the workpiece;

a perishable rack insert defining a coupling bearing surface and being operable for being removably secured upon said mounting surface of said carriage, said rack insert having a working surface with a series of feature-forming surfaces formed thereupon for cold-forming external surface configurations upon a metal workpiece; and said clamping assembly having a selectively translatable member with an engagement surface configured to engage the coupling bearing surface of the rack insert, the selectively translatable member having a shaft defining a ramped cam following surface, said selectively translatable member having a movable member disposed generally perpendicular to the shaft and having a cam configured to engage the cam following surface upon rotation of the rotatable member in a first direction, and to disengage the ramped cam following surface upon rotation of the rotatable member in a second direction;

wherein said rack insert is designed for a single use and is intended for disposal after said working surface becomes worn.

* * * * *